US007377889B2

(12) United States Patent
Cusak

(10) Patent No.: US 7,377,889 B2
(45) Date of Patent: May 27, 2008

(54) CHAIR PROVIDING DYNAMIC THRUST TO EXERCISE LUMBAR AREA OF SPINE

(76) Inventor: Stanley M. Cusak, 3985 N. Fresno St., Suite 106, Fresno, CA (US) 93726

( * ) Notice: Subject to any disclaimer, the term of this patent is extended or adjusted under 35 U.S.C. 154(b) by 851 days.

(21) Appl. No.: 10/749,313

(22) Filed: Dec. 30, 2003

(65) Prior Publication Data

US 2005/0147515 A1 Jul. 7, 2005

(51) Int. Cl.
*A63B 26/00* (2006.01)

(52) U.S. Cl. ..... 482/142; 297/452.32; 417/572

(58) Field of Classification Search ..... 482/142; 297/452.32, 21, 16.1, 23, 56, 92–93, 423.12–423.1, 297/313, 354.1, 317, 342, 353, 283.2, 337–8; 417/572, 230

See application file for complete search history.

(56) References Cited

U.S. PATENT DOCUMENTS

| | | | | |
|---|---|---|---|---|
| 4,845,987 | A | 7/1989 | Kenneth | |
| 5,110,121 | A | 5/1992 | Foster | |
| 5,113,176 | A | 5/1992 | Harris | |
| 5,288,130 | A | 2/1994 | Foster | |
| 5,380,269 | A | 1/1995 | Urso | |
| 5,718,476 | A * | 2/1998 | De Pascal et al. | 297/284.4 |
| 5,730,688 | A | 3/1998 | Prusick | |
| 5,810,875 | A | 9/1998 | Meilus | |
| 6,050,642 | A | 4/2000 | Erb | |
| 6,213,923 | B1 | 4/2001 | Cameron et al. | |
| 6,312,366 | B1 | 11/2001 | Prusick | |
| 2002/0033626 | A1 | 3/2002 | Yoo | |
| 2003/0057757 | A1 | 3/2003 | Martin | |
| 2003/0087737 | A1 | 5/2003 | Studdard | |

OTHER PUBLICATIONS

Tilt Forward for Stress-Free Sitting Posture! (Tilt Posture Chair 500L), p. 9, US.

* cited by examiner

*Primary Examiner*—Lori Amerson
(74) *Attorney, Agent, or Firm*—Richard A. Ryan

(57) ABSTRACT

A general use chair that is configured to provide a dynamic thrust motion to exercise the lower lumbar area of the user's spine to reduce pressure on the user's spine, joints and tissue and promote improved circulation throughout the user's body, particularly the lower back and legs, so as to reduce fatigue, pain and general discomfort from sitting for long periods of time. The chair has a conventional seat and leg assembly components. In one configuration, a back support assembly is pivotally connected to a pair of vertical members extending upwardly from the seat. A lumbar thrust assembly connects to the back support assembly to project a lumbar roller forward and upward to apply the dynamic thrust motion to the user's lower back. The lumbar thrust assembly motion can be manually initiated by the user, by leaning back on the chair, or operatively controlled by a motor and controller unit.

20 Claims, 5 Drawing Sheets

CHAIR PROVIDING DYNAMIC THRUST TO EXERCISE LUMBAR AREA OF SPINE

CROSS-REFERENCE TO RELATED APPLICATIONS

Not Applicable.

BACKGROUND OF THE INVENTION

A. Field of the Invention

The field of the present invention relates generally to general use chairs and, more specifically, to such chairs that are configured to exercise the lower back of the person sitting in the chair. Even more specifically, the present invention relates to chairs that selectively provide dynamic thrust to exercise the lumbar area of the spine so as to reduce pain, stress, fatigue and injury associated with sitting in a chair for extended periods of time.

B. Background

As is well known, many people spend a significant amount of time sitting in a chair, often behind a desk or worktable. In fact, it is likely that sitting in a chair is the number one working position in the United State. This is also likely to be true in many other countries of the world. It is not uncommon for some people to spend extended periods of time, including stretches of several hours, sitting in a chair. The common chair is configured to provide a foundation upon which to sit and at least adequate physical support in order to allow the seated person to effectively and efficiently engage in the requirements of their tasks and/or partake in relaxation. The basic configuration for the chair, that being a seat portion configured for sitting on that is attached to and displaced above the ground by one or more legs and a backrest portion that attaches to the seat portion to provide some support for the person's back, has remained substantially the same for a very long period of time.

Unfortunately, it is well known that most people suffer from one or more physical problems or various discomforts as a result of sitting in the typical static chair for long periods of time. The more common physical complaints include fatigue, backache, joint pain, headaches, loss of circulation, edema and loss of alertness. Fatigue from sitting in a chair results primarily from a lack of physical movement, or only minimal physical movement, and generally poorly designed seating that causes bio-mechanical dysfunction and strain. As a result of this dysfunction and strain, postural muscles must remain in a high level of tone contraction in order to keep the person sitting in the chair and in a generally upright position. If the backrest of the chair does not properly fit the physical contours of the person sitting in the chair and no motion is applied to the person's back, the constant contraction of the person's postural muscles, combined with reduced circulation, contributes to the feeling of fatigue, as well as pain. Poorly designed chairs, or chairs which poorly fit the person sitting in the chair, encourage slumping, bending over and other poor seating postures, often subconsciously induced, in order to try to relieve muscular strain. It is well known that spinal disc pressure in a person's lower back is less when sitting in a relaxed position and greatest when bent over or forward.

The typical seating position involves flexion of the hamstrings, posterior rotation of the pelvis and excessive flattening of the anterior posterior lumbar curve in the spine. It is well known that spinal disc pressure is the greatest from sitting and that prolonged disc pressure with facet joint compression may contribute to pain. For instance, spinal disc pressure of the lower back is typically increased forty percent to ninety percent when sitting compared to disc pressure resulting from standing, which is increased forty percent or more compared to disc pressure resulting from a reclined or lying down position. Because of this, seventy percent or more of people over forty years of age experience back pain from prolonged sitting. In addition it is commonly known in the medical industry that sedentary workers, such as those who sit for long periods of time, are as likely to experience back pain as those workers who perform heavy manual labor.

Back problems, such as spinal disc pressure, are not the only area of the body negatively impacted by prolonged sitting. For instance, edema of the lower legs is known to be commonly induced or caused by a lack of movement, resulting in little or no circulation in the legs. The effect of this problem is pain and discomfort from leg swelling. Many people experience this problem in long airplane trips. Leg edema is a major problem due to the local pooling of blood, increased venous pressure to the heart, increased blood pressure and increased heart rate. It is also well known that varicose veins, hemorrhoids, cold feet and other "peripheral" venous disorders may result from long periods of sitting in a chair. This is particularly true when a person repeatedly has extended periods of time in sitting a chair, as is the case for many office workers.

As a result of the known problems associated with prolonged periods of time sitting in a chair, various procedures and mechanisms have been developed to improve comfort of the person sitting in the chair or, at least, reduce his or her discomfort. One simple solution is to avoid long stretches of time sitting in the chair by intermixing periods of sitting with standing, walking or other activity that allows the person to exercise his or her muscles and allow circulation that is deprived when sitting. Unfortunately, taking breaks to stand, walk or engage in other physical activity is not always allowed, possible or even practical. Various mechanical devices, including improved chair configurations, have been developed to address the problems commonly associated with sitting in a chair. Unfortunately, many of these mechanical solutions incorporate a number of adjustable parameters to attempt to solve the sitting problem, presumably under a theory that the more adjustments a chair has the more "ergonomic" it is. The reality is, however, that most people do not know how to properly utilize many of the adjustable mechanisms to obtain a "correct" sitting configuration. As with many devices, it may be possible that the less adjustments necessary the easier a chair may be to use and, therefore, more likely to be used correctly.

A number of chairs or exercise devices are presently available that address, to one degree or another, the problems with prolonged sitting described above. For instance, U.S. Pat. No. 5,113,176 to Harris describes a lumbar roll device having an audible alerting capability to indicate to the sitter that he or she is sitting incorrectly or that there is a need for exercise. A pressure switch on the lumbar roll, which has the remaining electronic components stored therein, attaches to a chair so that when the user slouches away from the lumbar roll the drop in pressure measured by the pressure switch causes an alarm to sound. U.S. Pat. No. 5,110,121 to Foster describes a chair for exercising the muscles of the lower back that includes spring resistant back pad and a stationary lumbar support pad. When engaged for exercise, the user leans backwards against the back pad and exercises his or her lower back with a leaning backward and forward type of motion (resisted by the back pad). U.S. Pat. Nos. 5,730,688 and 6,312,366, both to Prussick, describe a portable abdominal-lumbar exercise device that has an upright, flexible resilient member attached to the seat member so the user can "pivot" forward and backward against the resistance provided by the resilient member. As with the Foster patent, the lower back support provides stationary support to the lower back while the user leans backwards and forward. U.S. Pub. No. U.S. 2003/0057757 to Martin describes a therapeutic or orthopaedic chair that has a shaped back portion that pivots when the user leans back against the back portion. The back portion is shaped to provide support to the lumbar region of the person's back.

Although the prior art discloses a number of chairs configured to exercise and/or support the lumbar area of the user's lower back, there are certain characteristics of the known chairs that limit their complete acceptance, usefulness and/or cost effectiveness. For instance, as stated above, it is well known that chairs that require very much adjustment or fine tuning are typically not going to be utilized to their fullest extent and are likely to be set improperly. In addition, some known devices are not adaptable to different chair configurations or are limited in their ability to provide the desired physical motion to the lumbar area of the user's spine. What is needed, therefore, is an improved chair that efficiently and effectively exercises the lumbar area of a person's spine to reduce or eliminate many of the problems associated with sitting in a chair for long periods of time. The preferred chair will utilize a dynamic thrust motion to induce a desired forward and upward force into the lumbar area of the user's spine so as to exercise the lower back to reduce fatigue, pain and circulation problems. The preferred chair should be adaptable to a large number of different chair configurations and adaptable for various mechanisms to supply the desired dynamic thrust to the user's lumbar area, including manual, electrical, hydraulic and pneumatic mechanisms. The preferred chair should be easy to use and require few adjustments to obtain the desired effects.

SUMMARY OF THE INVENTION

The chair of the present invention solves the problems and provides the benefits identified above. That is to say, the present invention discloses a chair configured to provide a dynamic thrust motion to exercise the lumbar area of the user's spine so as to reduce fatigue, pain, circulation problems and other discomforts known to be associated with sitting in a chair for long periods of time. The chair of the present invention is configured to be easily utilized and provide the desired exercise benefits while the person remains sitting in the chair. The user selects, typically on an intermittent basis, when he or she wants to receive the benefits of the dynamic thrust into his or her lumbar area. The chair of the present invention is adaptable to chairs of different configurations and does not require complicated adjustment mechanisms. The chair of the present invention is adaptable to utilizing manual or mechanical driving mechanisms to cause the dynamic thrust motion that exercises the lumbar area of the user's spine.

For purposes of this disclosure, the term "chair" includes all types of chairs that are or can be used by persons to sit for extended periods of time, including office chairs, dining chairs, airline seats, waiting chairs, camping or other outdoor-type chairs, treatment chairs and exercise chairs. Numerous other types of chairs may also be beneficially adapted to incorporate the chair of the present invention. With regard to the chair described herein, various components of the chair are adaptable to a number of different configurations and materials within the scope of the present invention. For instance, the seat and leg assembly portions of the chair of the present invention are adaptable to a number of well known variations in size and operation. The seat portion of the chair of the present invention can be sized and shaped as desired. The leg assembly portion of the chair of the present invention can include one or more leg members, such as the standard four legged chair, or have an adjustable cylinder base with a plurality of wheels on the bottom, such as the standard wheeled office chair (i.e., secretary or managerial type chairs). The chair of the present invention can be configured with one or more arms and/or arm assemblies. As well known in the art, a chair built according to the present invention can be manufactured out of wood, plastic, metal, composites, natural materials and various other materials and various combinations of such materials.

In one aspect of the present invention, the chair of the present invention includes a base assembly, a back support assembly and a lumbar thrust assembly. The back assembly has a seat, a leg assembly attached to the seat and configured to support the chair, and one or vertical members extending generally upwardly from the seat. The back support assembly, comprising a backrest member and/or frame, is pivotally attached to the one or more vertical members of the base assembly. The lumbar thrust assembly is attached to the back support assembly and configured to pivot therewith. The lumbar thrust assembly has a lumbar roller, one or more roller support members and one or more thrust support members. The lumbar roller is spatially disposed from the backrest member/frame and configured to project forward and upward relative to the rearward edge of the seat so as to apply a dynamic thrust motion to the lumbar area of the user's spine. The roller support members attach to the lumbar roller and the thrust support members interconnect the roller support members and the backrest member and/or frame. One or more channel members are attached to the back support assembly to slidably receive and engage the thrust support members. In the preferred configuration, the user manually activates the lumbar thrust assembly by leaning backward in the chair to create the desired dynamic thrust motion that pushes the lumbar roller against the user's lower back to exercise the lumbar area of the spine. In an alternative configuration, a motor is operatively connected to the lumbar thrust assembly to selectively project the lumbar roller forward and upward and a controller unit is operatively connected to the motor for selectively engaging the motor to operate the lumbar thrust assembly.

The chair of the present invention allows the user to selectively deliver an intermittent dynamic thrust movement to his or her lumbar spine area to exercise the lower back. Combined with a well supported, relaxed sitting position, the chair of the present invention satisfies the need-to-move feeling experienced by most persons who sit in chairs for extended periods of time and reduces spinal disc pressure, muscular strain and fatigue. The dynamic thrust motion of the chair of the present invention promotes blood circulation by producing a muscle pumping action, which also helps circulate nutrients and eliminate waste metabolites. The user's alertness is increased as afferent nerves send impulses to the user's central nervous system. The thrusting action of the chair also improves the health of the user's spine by reducing changes of pressure and encouraging the spine to "feed" the intervertebral spinal discs by a process known as passive diffusion. The chair also causes a redistribution of the pressure acting on the spine, joints and tissues and reduces overall pressure to improve the user's comfort. The dynamic thrust movement of the chair causes the associated muscle groups to extend and contract, thereby producing better circulation in this area. Leg edema and swelling is also reduced by intermittent use of the dynamic thrust of the chair. The chair of the present invention promotes and accommodates selective movement to allow the user to be healthier, more comfortable and more effective.

Accordingly, the primary objective of the present invention is to provide a chair for sitting that provides the advantages discussed above and that overcomes the disadvantages and limitations associated with presently available chairs.

It is also an important objective of the present invention to provide a chair that utilizes an intermittent dynamic thrust motion to exercise the lumbar area of the user's spine so as to reduce problems commonly associated with prolonged or extended periods of time sitting in a chair, such as fatigue, pain, circulation problems and other discomforts.

It is also an important objective of the present invention to provide a chair that has a lumbar roller pivotally attached to the chair to induce a forward and upward motion into the lumbar area of the user's spine.

It is also an important objective of the present invention to provide a chair that is configured to utilize the user's own motion to provide a forward and upward dynamic thrust into the user's lumbar area of the spine or can be configured to utilize a mechanical device, such as an electric, hydraulic or pneumatic motor, to provide the desired thrusting motion.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with reference to the embodiments of the chair of the present invention illustrated in the figures, various preferred embodiments of the present invention are set forth below. The enclosed description and drawings are merely illustrative of preferred embodiments and represent several different ways of configuring the present invention. Although specific components, materials, configurations and uses of the present invention are illustrated and set forth in this disclosure, it should be understood that a number of variations to the components and to the configuration of those components described herein and in the accompanying figures can be made without changing the scope and function of the invention set forth herein.

Figure 2:
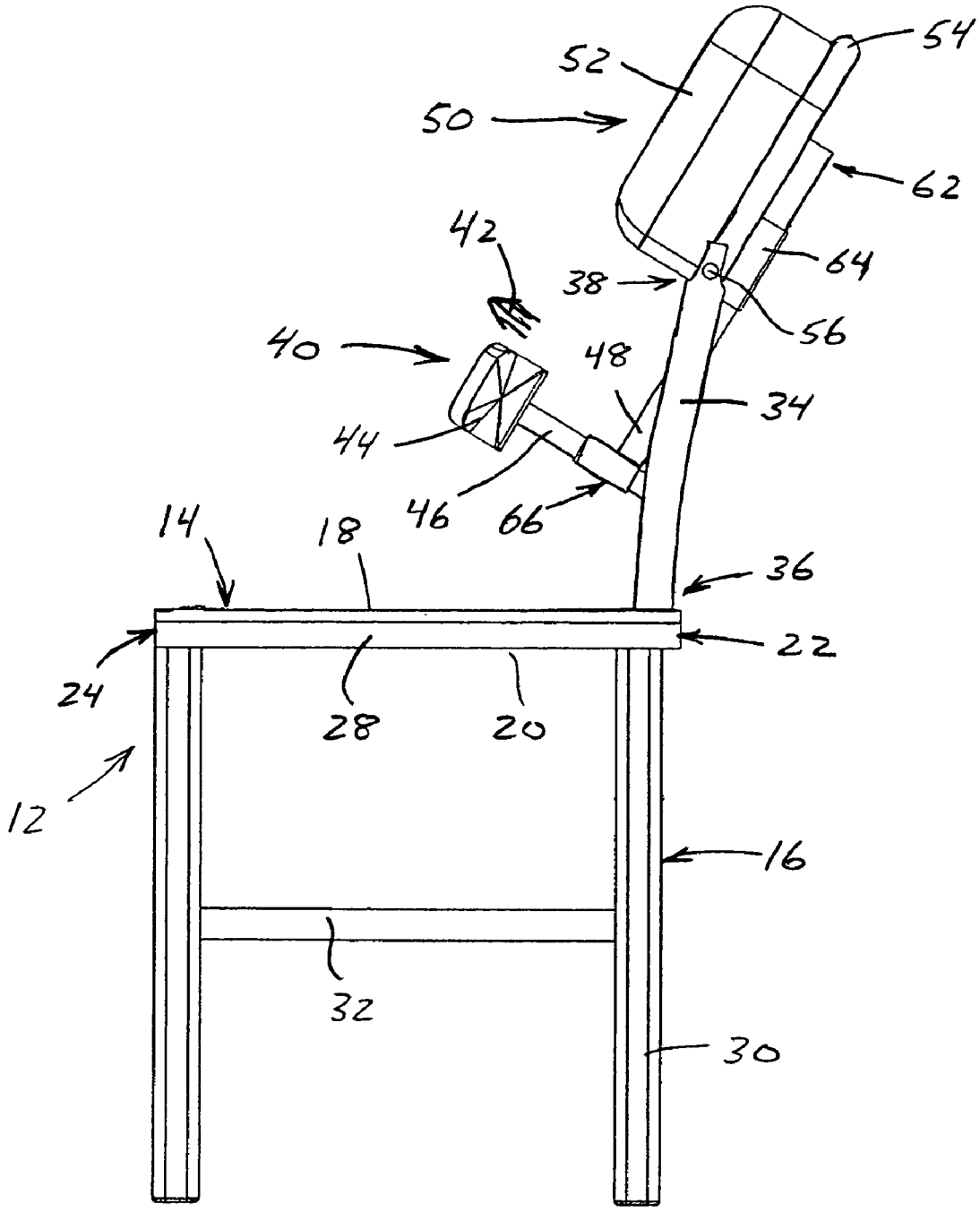
FIG. 2 is a side view of the chair of FIG. 1.

The chair of the present invention, identified generally as 10 in the figures, can be configured in a number of different ways within the scope of the present invention. In the configuration shown in the figures, chair 10 comprises a base assembly 12 having a seat 14 and leg assembly 16 to support chair 10 and displace seat 14 a desired distance above the ground or floor. As best shown in FIG. 2, seat 14 has an upper surface 18 and an opposite facing lower surface 20. Seat 14 is bound by rearward edge 22, forward edge 24 and opposing sides 26 and 28. Generally, but not required, leg assembly 16 attaches to lower surface 20 of seat 14. Seat 14 is configured for the user to sit thereon and leg assembly 16 is configured to support the combined weight of chair 10 and the user. The typical leg assembly 16 comprises one or more leg members 30, such as the four shown in the figures, that can be joined by one or more transverse support members 32 to provide addition support to leg assembly 16 and chair 10. In the figures, base assembly 12 also includes a pair of vertical members 34, each having a first end 36 attached to upper surface 18 of seat 14 and a second end 38 at the opposite end of vertical members 34. Vertical members 34 may also attach to the sides 26 and 28 or bottom surface 20 of seat 14. In the typical configuration of chair 10, vertical members 34 support or form part of the back of chair 10 to support at least the user's lower back.

Figure 3:
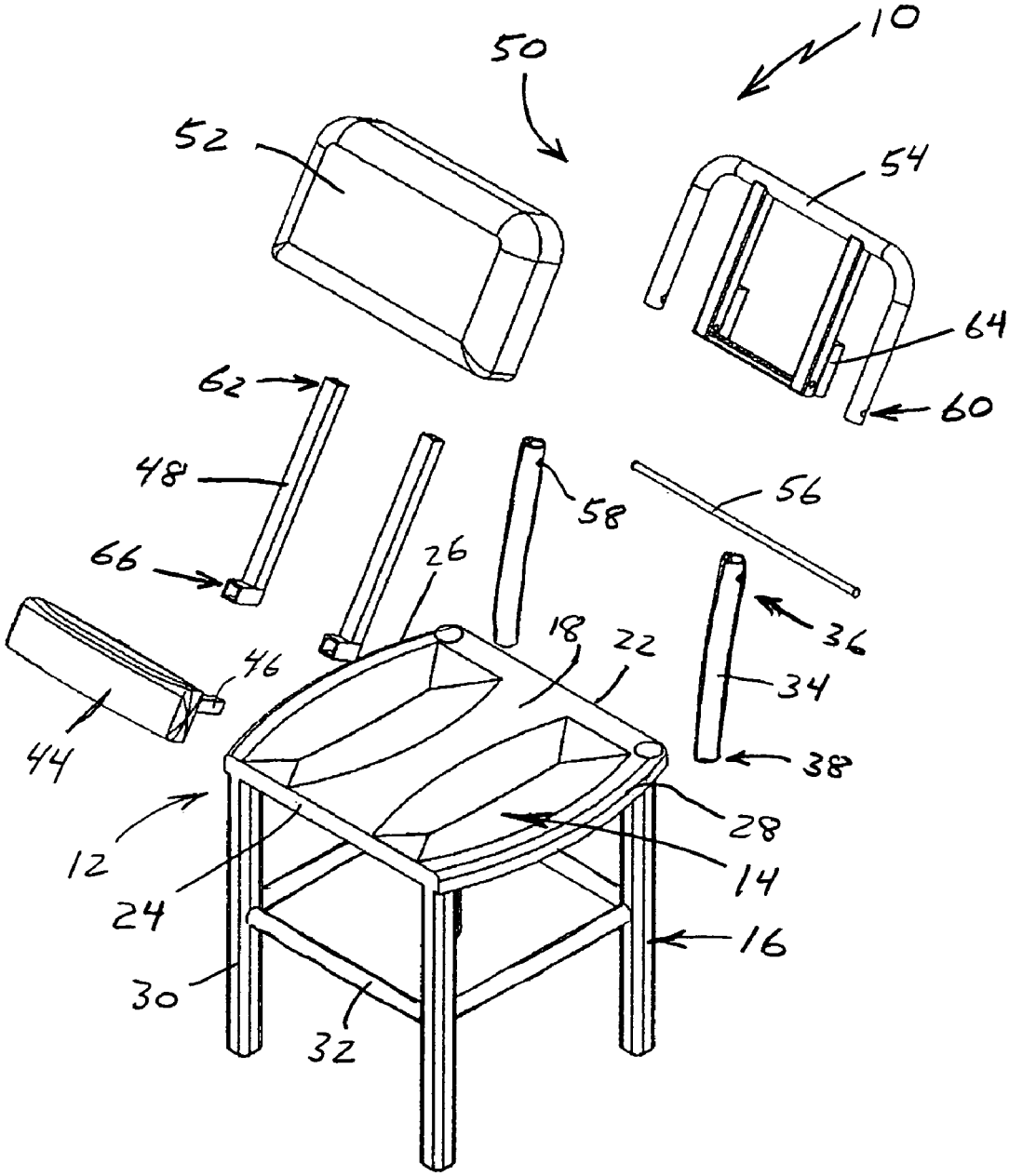
FIG. 3 is an exploded perspective view of the chair of FIG. 1.

To accomplish the objectives of the present invention, chair 10 has a lumbar thrust assembly 40 that is configured to selectively provide a dynamic thrust motion 42, shown as a directional arrow in FIG. 2, into the lumbar area of the user's spine. As shown in the figures, lumbar thrust assembly 40 independently projects forward from the back (i.e., vertical members 34) of chair 10. When activated to exercise the lumbar area of the user's spine, lumbar thrust assembly 40 provides the dynamic thrust motion 42 in a generally forward and upward direction relative to rearward edge 22 of seat 14. In a preferred embodiment of chair 10 of the present invention, lumbar thrust assembly 40 comprises lumbar roller 44, roller support members 46 attached to lumbar roller 44, and thrust support members 48 attached to roller support members 46, as best shown in FIGS. 2 and 3. In the preferred embodiment of chair 10, lumbar thrust assembly 40 is attached to and moves with back support assembly 50, which includes backrest member 52 and backrest frame 54. As explained in more detail below, a pivot member, such as axle or rod 56, interconnecting lumbar thrust assembly 40, back support assembly 50 and vertical members 34 of base 12, allows back support assembly 50 to pivot rearward to provide the desired dynamic thrust motion 42 of lumbar thrust assembly 40. In the preferred embodiment of chair 10 of the present invention, lumbar roller 44 is a padded material that will not inflict injury on the user of chair 10 or damage his or her clothing. In one configuration, lumbar roller 44 includes a section of compressible foam material covered with a smooth outer casing or coating, such as plastic or leather. In another configuration, lumbar roller 44 is a solid material. Lumbar roller 44 should be shaped and configured to beneficially facilitate the desired directional pressure 42 (i.e., the thrusting motion) into the user's lumbar area. Although a generally rectangular cross-section lumbar roller 44 is shown in the figures, lumbar roller 44 can comprise various other shapes and configurations, including circular cross-section or a non-uniform cross-section.

Figure 1:
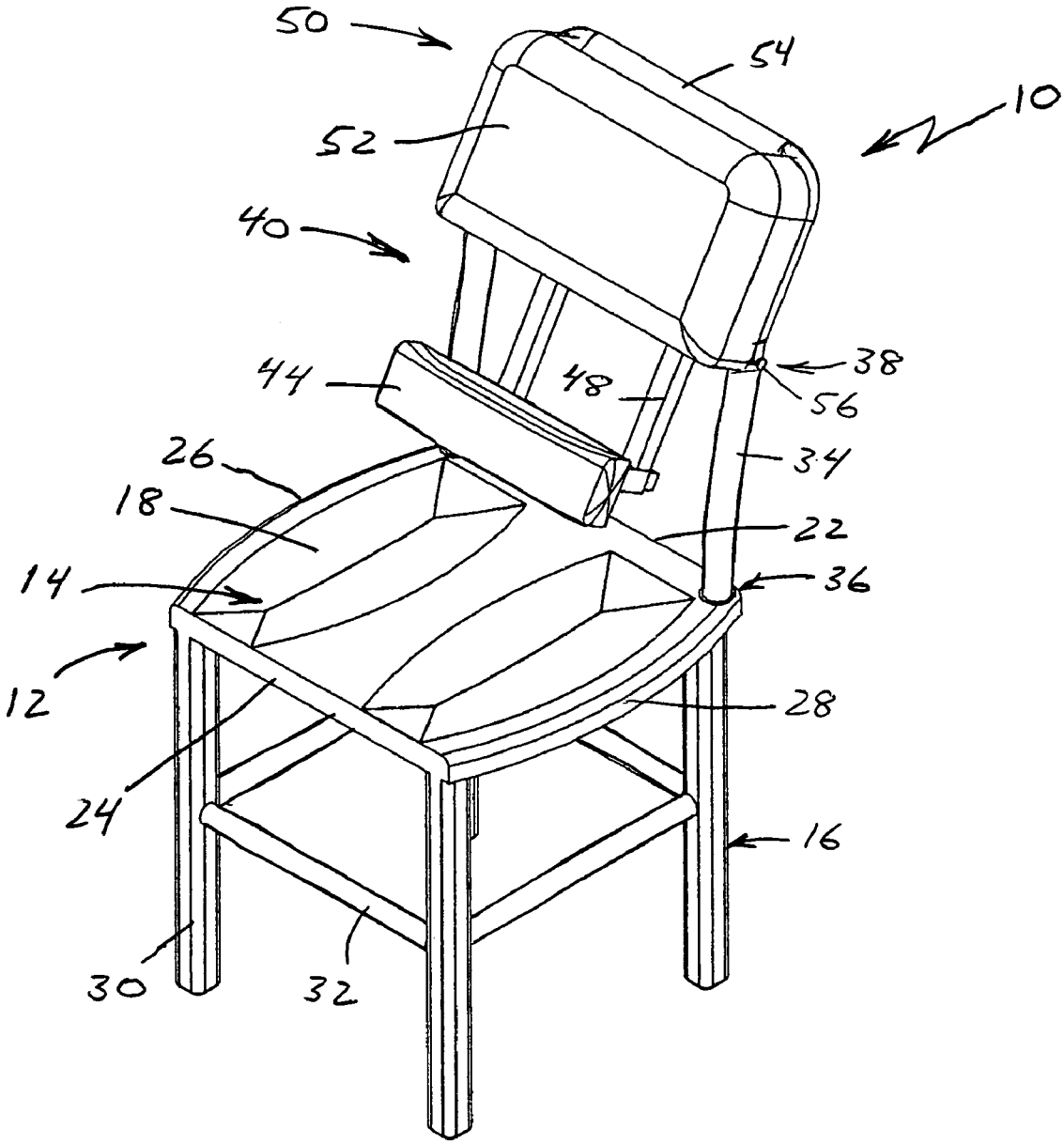
FIG. 1 is a perspective view of one configuration of the chair of the present invention.

In the embodiment shown in FIGS. 1 through 5, backrest frame 54 attaches at or near second end 38 of vertical member 34 by inserting rod 56 through holes 58 in tubular vertical members 34 and corresponding holes (not shown) in thrust support members 48 and backrest frame 54. Backrest frame 54 is configured with a pair of insert ends 60 which are sized and configured to be received in the open tubular second ends 38 of vertical members 34. First end 62 of thrust support members 48 are slidably received in channel members 64, which are fixedly mounted or attached to backrest frame 54, such that rod 56 is directed through one set of insert end 60 of backrest frame 54, second end 38 of vertical member 34, channel member 64 and first end 62 of thrust support member 48 and then, in reverse order, through the second set of these components. As known to those skilled in the art, a pin or other connector (not shown) can be used at one or both ends of rod 56 to keep rod 56 and the other components in place. With back support assembly 50 pivotally mounted to vertical members 34, rearward pressure on backrest 52 will result in the second ends 66 of thrust support members 48 pivoting forward and upward relative to the rearward edge 22 of seat 14 to provide the desired dynamic thrust motion 42. As best shown in FIG. 1, the ends of roller support members 46 that are opposite lumbar roller 44 attaches to the second end 66 of thrust support members 48.

Chair 10 of the present invention is configured provide the dynamic thrust motion 42 at a specific spinal level by thrusting forwardly and upwardly relative to the rearward edge 22 of seat 14 in order to exercise the lower lumbar area of the user's spine and produce the desired health benefits. The dynamic thrust motion 42 should be directed to the general area of the spine designated as L3-4, which is approximately six to nine inches from the flat base of the chair. Therefore, the movement from posterior to anterior and from inferior to superior and the tracking motion forward and upward will cover up to ten inches. To achieve the desired results, lumbar thrust assembly 40 should pivot through the open space above seat 14, such as that formed between seat 14, vertical members 34 and back support assembly 50 in the figures. In this manner, chair 10 will provide the desired dynamic thrust motion 42 to achieve the benefits of the present invention. Unlike prior art chairs that have pivoting back supports, with or without padding or extensions at the lumbar area in continuous relationship with the back supports, chair 10 utilizes lumbar roller 44 which is spatially disposed from the back support (i.e., backrest member 52 or, if no backrest member 52 is utilized, backrest frame 54). Dynamic thrust motion 42 of chair 10 promotes circulation by producing a muscle pumping action, redistributes the pressure acting on the user's spine, joints and tissues, and causes the associated muscle groups to extend and contract. Intermittent use of chair 10 to produce dynamic thrust motion 42 also reduces leg edema and swelling to promote a more healthier, comfortable and effective user.

As is well known in the art, various alternative components of chair 10 can be utilized to obtain the same desired benefits. For instance, seat 14 can be shaped and configured in a number of different shapes and configurations, including round shapes and a contoured surface. Instead of utilizing a single continuous rod 56 as the pivot member, two or more short pivot members (i.e., one on each side of chair 10) can be utilized to allow lumbar thrust assembly 40 to pivot forward and upward relative to base assembly 12. Thrust support members 48 can be configured to be adjustable to allow the user to adjust the height of lumbar roller 48 above seat 14. Although chair 10 can be configured to fit most of the adult population by utilizing anthropometric tables, increased adjustability may be necessary to accommodate the relatively small number of people at the extremes, such as those who are very tall or very short. Roller support members 46 can also be made to be adjustable in length to allow the user to adjust the distance from the back of chair 10 which lumbar roller 44 will project in the non-activated and activated (produce dynamic thrust motion 42) conditions. Although the figures show chair 10 with pairs of vertical members 34, roller support members 46 and thrust support members 48, those skilled in the art will recognize that chair 10 can be made with one or more of such members and still accomplish the objectives of the present invention.

In use, chair 10 can be adapted to be virtually any type of general use chair, such as office chairs, desk chairs and guest chairs, or it can be adapted for use as part of a special purpose chair, such as airline seats, vehicle seats, camping chairs and exercise chairs. For the embodiment described above, the user would most often use chair 10 in the normal manner in which chairs are generally used. Intermittently, as selected by the user, the user can exercise his or her back to obtain the benefits described above. All the user must do is to lean back against backrest member 52 of back support assembly 50. The rearward force against backrest member 52 will cause backrest member 52 and backrest frame 54 to pivot around rod 56. The pivoting of back support assembly 50, with thrust support members 48 attached thereto, will cause lumbar roller 44 to be directed generally forward and upward relative to rearward edge 22 of seat 14, thereby providing the desired dynamic thrust motion 42. This will direct the desired pressure to the lumbar area of the user's spine, reducing pressure on the user's spine, joints and tissue and promoting improved circulation throughout the user's body, particularly the lower back and legs. In its preferred configuration, there is not much adjustments necessary or possible, thereby reducing or eliminating the likelihood that chair 10 is not adjusted properly.

For some uses, it may be desired to include a lock/release mechanism (not shown) with chair 10 that locks lumbar thrust assembly 40 and back support assembly 50 in place. For instance, in some circumstances the user may not want back support assembly 50 to pivot and lumbar thrust assembly 40 to direct lumbar roller 44 into his or her back. With the lock/release mechanism engaged in the lock position, back support assembly 50 could be placed in a substantially upright, vertical position, such that backrest member 52 is substantially parallel to the user's back, with lumbar roller 44 only abutting the user's back. When the lock/release mechanism is released, the user can lean back on back support assembly 50 and cause lumbar thrust assembly 40 to pivot forward and upward into the lumbar area of the user's spine. As is well known in the art, various lock/release mechanism are adaptable for use with chair 10 of the present invention.

Although chair 10 in the figures is shown with lumbar thrust assembly 40 attached to back support assembly 50, other configurations can be utilized. For instance, lumbar thrust assembly 40 can connect or attach to seat 14, leg assembly 16 and/or vertical members 34. In any of these alternative configurations, one or more thrust support members 48 can connect to one or more roller support members 46, that attach to lumbar roller 44, to provide the desired forward and upward dynamic thrust motion 42. In these configurations, it may be desired to have back support assembly 50 fixed in position on chair 10 and to utilize a different mechanism to initiate the desired dynamic thrust motion 42 to cause lumbar roller 44 to beneficially impact the user's lower back. Such a mechanism should be user-initiated and can include a button, switch, hand lever, foot pedal or other initiating device to cause lumbar thrust assembly 40 to direct lumbar roller 44 into the user's lower back.

Figure 4:
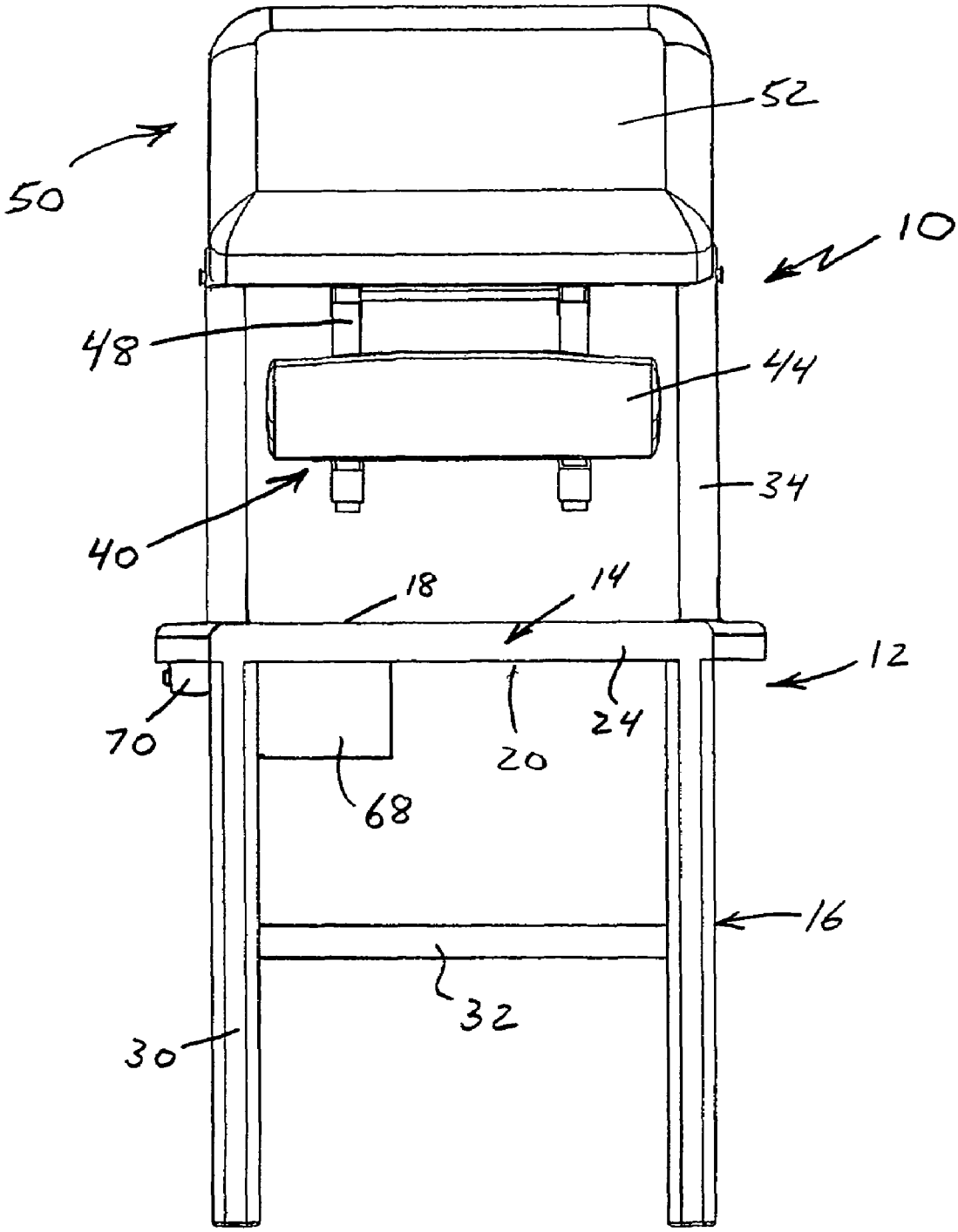
FIG. 4 is a front view of the chair of FIG. 1 showing use of a motor and controller unit attached to the seat of the chair.
Figure 5:
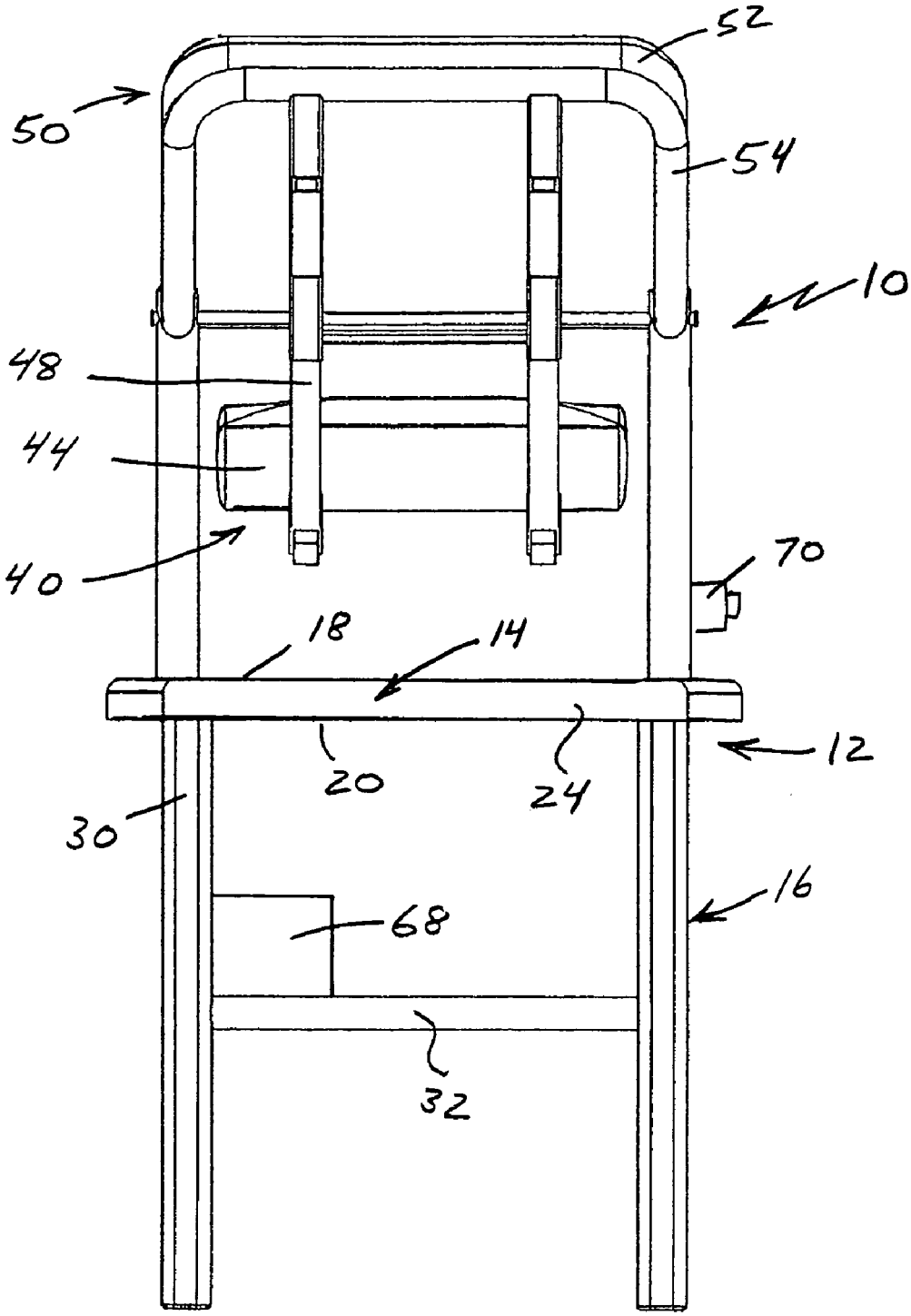
FIG. 5 is a back view of the chair of FIG. 1 showing use of a motor attached to the leg assembly and a controller unit attached to one of the vertical members of the base assembly.

The preferred embodiment of chair 10 of the present invention allows the user to manually pivot lumbar thrust assembly 40 to create the desired dynamic thrust motion 42 to push lumbar roller 44 into the lumbar area of his or her spine. In an alternative embodiment of chair 10 of the present invention, lumbar thrust assembly 40 is pivoted by use of a motor 68, shown in FIGS. 4 and 5. As known in the art, motor 68 is connected to lumbar thrust assembly 40 by way of appropriate linkage mechanisms (not shown) such that when motor 68 is engaged the linkage mechanisms will cause lumbar thrust assembly 40 to drive lumbar roller forward and upward, relative to the rearward edge 22 of seat 14, to create the desired dynamic thrust motion 42. The motor-actuated linkage and lumbar thrust assembly 40 will create the directed pressure benefits described above without the need for the user to manually cause lumbar thrust assembly 40 to pivot. To utilize motor 68, it is preferred that chair 10 include a controller unit 70 that is easily accessible by the user. Controller unit 70 should include an on/off switch to allow the user to initiate motor 68 and cause the desired dynamic thrust motion 42 to provide the benefits described above. If desired, controller unit 70 should include a control mechanism to allow the user to set controller unit 70 for automatic and periodic operation of lumbar thrust assembly 40. For instance, controller unit 70 can be set to provide dynamic thrust motion 42 into the user's lower back for a period of five minutes once every hour, or more or less frequently. In this way, the user will not have to remember to periodically activate lumbar thrust assembly 40, nor will he or she have to wait until pain or other discomfort is felt before remembering to exercise his or her lower back. As known to those skilled in the art, motor 68 can be electric, hydraulic, pneumatic or various other types of motors suitable for actuating lumbar thrust assembly 40. In many circumstances, such as indoor office settings, a preferred motor 68 is an electric motor that connects to an electric outlet or which is powered by one or more batteries. As shown in FIG. 4, motor 68 and controller unit 70 can attach to lower surface 20 of seat 14 or, as shown in FIG. 5, motor 68 can attach to leg assembly 16 with controller unit 70 attached to one of vertical members 34. In either configuration, the appropriate linage mechanism can be disposed in one or more of the tubular components of chair 10, such as seat 14, leg assembly 16, vertical members 34 and backrest frame 54. Various other locations and combinations of locations are also possible for motor 68, controller unit 70 and the necessary linkage mechanism.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A chair for providing dynamic thrust to exercise the lumbar area of the spine, comprising:

a base assembly having a seat and a leg assembly attached to said seat, said seat having a rearward edge and a forward edge, said leg assembly configured to support said chair; and a lumbar thrust assembly pivotally attached to said base assembly, said lumbar thrust assembly having a lumbar roller, one or more roller support members and one or more thrust support members, said lumbar roller configured to project forward and upward relative to said rearward edge of said seat so as to apply a dynamic thrust motion to the lumbar area of the spine, said lumbar roller spatially disposed from said base assembly. said one or more roller support members attached to said lumbar roller, said one or more thrust support members interconnecting said roller support members and a backrest frame.

2. The chair according to claim 1, wherein said lumbar thrust assembly further comprises a back support assembly, said back support assembly having a backrest frame pivotally attached to said base assembly, said lumbar roller attached to said backrest frame to pivot therewith, said lumbar roller spatially disposed from said backrest frame.

3. The chair according to claim 2, wherein said base assembly further comprises one or more vertical members attached to said seat and extending generally upwardly therefrom, said backrest frame attached to said one or more vertical members.

4. The chair according to claim 3, wherein said backrest frame is pivotally attached to said one or more vertical members.

5. The chair according to claim 2, wherein said back support assembly has a backrest member to abut the user's back.

6. The chair according to claim 1, wherein said backrest frame has one or more channel members, each of said one or more channel members configured to slidably receive and engage one of said one or more thrust support members.

7. The chair according to claim 1 further comprising a motor operatively connected to said lumbar thrust assembly to selectively project said lumbar roller forward and upward.

8. The chair according to claim 7 further comprising a controller unit operatively connected to said motor for selectively engaging said motor and operating said lumbar thrust assembly.

9. A chair for providing dynamic thrust to exercise the lumbar area of the spine, comprising:

a base assembly having a seat, a leg assembly and one or vertical members, said seat having a rearward edge and a forward edge, said leg assembly attached to said seat, said leg assembly configured to support said chair, said one or more vertical members attached to said seat and extending generally upwardly therefrom;

a back support assembly pivotally attached to said base assembly; and a lumbar thrust assembly attached to said back support assembly and configured to pivot therewith, said lumbar thrust assembly having a lumbar roller configured to project forward and upward relative to said rearward edge of said seat so as to apply a dynamic thrust motion to the lumbar area of the spine, said lumbar roller spatially disposed from said back support assembly.

10. The chair according to claim 9, wherein said lumbar thrust assembly further comprises one or more roller support members and one or more thrust support members, said one or more roller support members attached to said lumbar roller, said one or more thrust support members interconnecting said roller support members and said back support assembly.

11. The chair according to claim 10, wherein said back support assembly has a backrest frame pivotally attached to said one or more vertical members of said base assembly, said lumbar thrust assembly attached to said backrest frame.

12. The chair according to claim 11, wherein said backrest frame has one or more channel members, each of said one or more channel members configured to slidably receive and engage one of said one or more thrust support members.

13. The chair according to claim 9 further comprising a motor operatively connected to said lumbar thrust assembly to selectively project said lumbar roller forward and upward.

14. The chair according to claim 13 further comprising a controller unit operatively connected to said motor for selectively engaging said motor and operating said lumbar thrust assembly.

15. A chair for providing dynamic thrust to exercise the lumbar area of the spine, comprising:

a base assembly having a seat, a leg assembly and one or vertical members, said seat having a rearward edge and a forward edge, said leg assembly attached to said seat, said leg assembly configured to support said chair, said one or more vertical members attached to said seat and extending generally upwardly therefrom;

a back support assembly having a backrest frame pivotally attached to said one or more vertical members of said base assembly; and a lumbar thrust assembly attached to said backrest frame and configured to pivot therewith, said lumbar thrust assembly having a lumbar roller, one or more roller support members and one or more thrust support members, said lumbar roller spatially disposed from said backrest frame and configured to project forward and upward relative to said rearward edge of said seat so as to apply a dynamic thrust motion to the lumbar area of the spine, said one or more roller support members attached to said lumbar roller, said one or more thrust support members interconnecting said one or more roller support members and said backrest frame.

16. The chair according to claim 15, wherein said backrest frame further comprises one or more channel members, each of said one or more channel members configured to slidably receive and engage one of said one or more thrust support members.

17. The chair according to claim 15 further comprising a motor operatively connected to said lumbar thrust assembly to selectively project said lumbar roller forward and upward.

18. The chair according to claim 17 further comprising a controller unit operatively connected to said motor for selectively engaging said motor and operating said lumbar thrust assembly.

19. A chair for providing dynamic thrust to exercise the lumbar area of the spine, comprising:

a base assembly having a seat and a leg assembly attached to said seat, said seat having a rearward edge and a forward edge, said leg assembly configured to support said chair;

a lumbar thrust assembly pivotally attached to said base assembly, said lumbar thrust assembly having a lumbar roller configured to project forward and upward relative to said rearward edge of said seat so as to apply a dynamic thrust motion to the lumbar area of the spine, said lumbar roller spatially disposed from said base assembly; and a motor operatively connected to said lumbar roller assembly to selectively project said lumbar roller forward and upward.

20. The chair according to claim 19 further comprising a controller unit operatively connected to said motor for selectively engaging said motor and operating said lumbar thrust assembly.

* * * * *